US005429277A

United States Patent [19]

Kopp et al.

[11] Patent Number: 5,429,277

[45] Date of Patent: Jul. 4, 1995

[54] MEMBER FOR DISPENSING A TWO-COMPONENT MASS FROM A TOOL SEPARATELY DISCHARGING THE COMPONENTS

[75] Inventors: Volker Kopp, Esslingen, Germany; Werner Moser, Uetikon, Switzerland; Jürgen Kortenkamp, Dornbirn, Germany

[73] Assignee: Hilti Aktiengesellschaft, Schaan, Liechtenstein

[21] Appl. No.: 92,304

[22] Filed: Jul. 14, 1993

[30] Foreign Application Priority Data

Jul. 24, 1992 [DE] Germany ..... 42 24 497.8

[51] Int. Cl.[6] ..... B67D 5/60

[52] U.S. Cl. ..... 222/145.6

[58] Field of Search ..... 222/14.5; 239/412, 413, 239/452, 533.1, 533.13, 533.15

[56] References Cited

U.S. PATENT DOCUMENTS

| | | | |
|---|---|---|---|
| 384,306 | 6/1888 | Bourdil | 239/533.13 |
| 1,164,350 | 12/1915 | Huber | 222/145 |
| 1,445,826 | 2/1923 | Fesler | 239/412 |
| 2,503,534 | 4/1950 | Wilks | 239/412 |
| 3,015,420 | 1/1962 | Chudnow | 222/145 |
| 3,693,656 | 9/1972 | Sauer | 239/533.1 |
| 3,908,868 | 9/1975 | Peirish, Jr. | 222/145 |
| 4,907,957 | 3/1990 | Nakagawa et al. | 425/133.1 X |
| 5,080,262 | 1/1992 | Herold et al. | 222/145 |

FOREIGN PATENT DOCUMENTS

| | | | |
|---|---|---|---|
| 3802519 | 8/1989 | Germany | 222/145 |
| 670580 | 6/1989 | Switzerland . | |
| 1003320 | 9/1965 | United Kingdom | 239/533.15 |
| 2256636 | 12/1992 | United Kingdom | 222/145 |

*Primary Examiner*—Andres Kashnikow
*Assistant Examiner*—Kenneth Bomberg
*Attorney, Agent, or Firm*—Anderson Kill Olick & Oshinsky

[57] ABSTRACT

Member for mixing and dispensing a two-component mass from a tool arranged to separately squeeze-out the two components. The member includes a mixing tube (1) enclosing a coaxial tube section (2) connected to the front end (3) of the tool for conveying one of the components from a tool outlet (**3*b*) to the mixing tube (1). Another tool outlet (3*a*) conveys the other component directly into the mixing tube (1). The tube section (2) has a one-way valve at an outlet opening (2*b*) into the mixing tube (1). The one-way valve includes an expandable tubular sheath (5) covering the outlet opening (2*b*) through the tube section (2). The one-way valve prevents any backflow of the mixed components from the mixing tube into the tube section. Mixed components which harden within the mixing tube (1**) form a seal or block. Accordingly, when the tool squeezing out the component is operated with a blocked or sealed mixing tube, no backflow into the tool can occur.

3 Claims, 2 Drawing Sheets

MEMBER FOR DISPENSING A TWO-COMPONENT MASS FROM A TOOL SEPARATELY DISCHARGING THE COMPONENTS

BACKGROUND OF THE INVENTION

The present invention is directed to a member for dispensing a two-component mass from a tool arranged to separately squeeze out the two components. The member includes a mixing tube connected to a dispensing part of the tool equipped with two outlets each for a different one of the components.

A tool for squeezing out two components is known, such as disclosed in CH-PS 670 580. In this embodiment the tool has an outlet for each of the components. The individual components are separated from one another within the tool and enter into an outlet member through the two outlets and the outlet member is connected to the dispensing end of the tool. The two components are mixed within the outlet member and such intermixing is necessary for the curing or hardening of the two component mass. If such a tool is used and then remains idle for a given period, the mixed components inside the outlet member harden. As a result, it is necessary to replace the member filled with the hardened mass by a new member, so that the components can be squeezed out of the tool and mixed inside the new member. The discharge of the individual components in the known squeeze-out tool is effected by generating a given pressure inside the tool. Such a pressure can be produced manually or by means of a separately supplied pressure medium. If such a pressure is applied, such as in error, without having removed the member filled with the hardened components, there is the danger that one of the components is forced back into the tool through the outlet for the other component. As a result, an intermixing of the components can take place inside the squeeze-out tool, whereby hardening occurs within the tool, possibly causing it to malfunction. Such a malfunction can only be corrected by time-consuming operations, such as disassembling and cleaning the tool. The backflow of the component occurs in a random fashion, mostly as a function of the viscosity differences and possible pressure differences acting on the individual components.

SUMMARY OF THE INVENTION

Therefore, it is the primary object of the present invention to provide a member for the tool of the type previously described, whereby malfunction of the tool caused by backflow of one of the components into the other within the tool are avoided.

In accordance with the present invention at least one one-way valve admits one component into a mixing tube of the member so that the components can be mixed.

The member of the present invention with at least one one-way valve cooperating with one of the component outlets from the tool assures that at least one of the components is passed through the valve, so that mixing with the other component can be effected only within the mixing tube of the member. The one-way valve opens only for as long as the component flows through it. As soon as the pressure squeezing the component out of the tool is discontinued, the one-way valve closes preventing any further flow of the component into the mixing tube and, in addition, the other component introduced into the mixing tube cannot flow back through the valve. If the discharge of the components from the tool is interrupted for a given time period and the mixed components harden in the mixing tube, the hardening occurs first at the location where the individual components meet, that is, in the region of the one-way valve. Accordingly, a part of the hardened mass can form around the one-way valve with the result that the mixing tube is sealed or closed relative to the tool by the amount of the hardened components. If the member including the mixing tube filled with a part of the hardened components is not, in error, exchanged for a new member before applying pressure to the tool for squeezing out the components, it merely means that the individual components within the member arrive as separate flows at the block formed by the hardened components. Due to the separation of the individual components they cannot intermix and any backflow of the components into the tool are avoided.

In this member, including the mixing tube, embodying the present invention, an expendable or throw-away part is involved which must be replaced on the tool once the squeezing-out of the components is interrupted. For effectively dispensing the individual components out of the tool the dispensing end of the tool must be provided with a new member, as has been required in the past.

Appropriately, the one-way valve is located on a tube section, at an outlet from the tube section, spaced from a location where the tube section is connected to the tube. Further, the tube section is located coaxially within the mixing tube. Accordingly, the separate component outlets in the tool are separated from one another and such arrangement is especially advantageous if only one of the outlets cooperates with a one-way valve. Only after one of the components passes through the tube section and then through the one-way valve, is it possible for the components to mix in the mixing tube.

To achieve adequate intermixing of the individual components, preferably the tube section is disposed coaxially within the mixing tube. As a result, the tube section affords a passage for one component and the annular space about the tube section within the mixing tube provides a passage for the other component. The annular space about the tube section and within the mixing tube, if necessary, can be interspersed with ribs serving, on the one hand, to stabilize the tube section and, on the other hand, to permit a sufficient open space for the passage of the other component between the tube section and the mixing tube.

The one-way valve can be formed by one or a number of openings in the tube section covered by an elastically deformable part. The openings from the tube section form radial passageways in the discharge region of the tube section. An elastic sheath or envelope is expediently suited as the elastically deformable part for the radially arranged passageways with the sheath enclosing the passageways or openings. Preferably, the sheath has the shape of a hose.

To obtain effective operation of the one-way valve, advantageously the elastic sheath is connected at its end more remote from the tool to the outlet end of the tube section with its opposite end being elastically deformable due to the pressure of the component flowing through the tube section. Thus a reversing baffle is formed for the component flowing through the tube section which, on the one hand, has an advantageous effect on the mixing operation and, on the other hand, advantageously forms the seal of block when the components harden within the mixing tube.

In principle, it is sufficient with the present invention to provide a one-way valve for only one of the component outlets. For an additional embodiment, depending on the shape of the tool as well as the requirements for the components being used, an additional one-way valve is preferably positioned in the region of the other component outlet. Since this additional one-way valve is located in the region of the component outlet, the space between the outlets into the mixing tube is maintained, that is, the one-way valves are in spaced relation, thereby undesirable mixing of the individual components is avoided due to the spaced relation of the valve and, in addition, the mode of operation of the valves is maintained.

Preferably, the additional one-way valve is a bellows which can be axially collapsed by the pressure of the component flowing through the second outlet. Such a bellows functions as an elastically deformable part analogous to a one-way valve with the only difference being that the elastic bellows is axially deformable while the elastic sheath is radially deformable.

Due to its inherent stress, the bellows forms a closure for the second outlet until it is displaced by the pressure of the component flowing out of the second outlet.

The mixing tube is dimensioned with regard to its length so that it projects axially from the one or the two one-way valves, regardless of the number of the one-way valves used. A sufficiently long mixing length is obtained assuring a sufficient intermixing of the individual components.

Advantageously, the member embodying the invention is used along with a tool for squeezing-out the components with one outlet discharging directly into the mixing tube and the other outlet discharging into the tube section located coaxial with the mixing tool with the outlet from the tube section spaced closer to the outlet from the member relative to the outlet opening directly into the mixing tube. With the tool arranged in this fashion the outlet discharging directly into the mixing tube serves for dispensing prepolymers or similar resins while the outlet discharging into the tube section provides for dispensing an activation agent.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
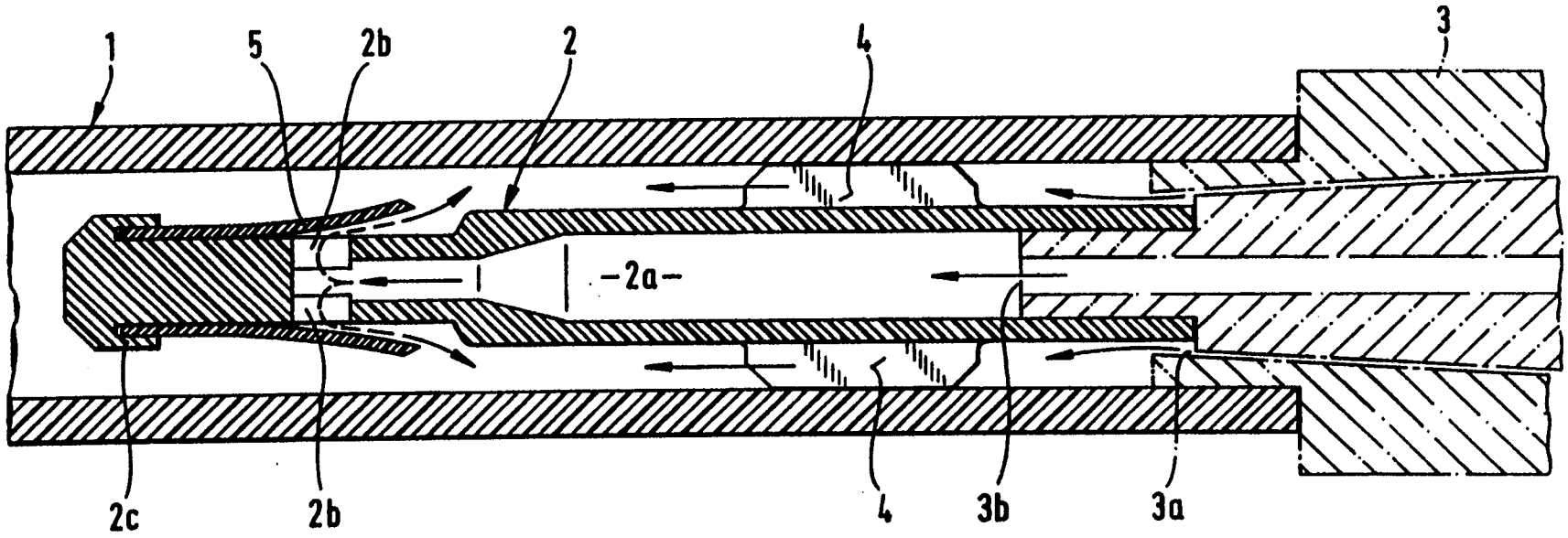
FIG. 1 is an axially extending sectional view of a member including one one-way valve and illustrating diagrammatically the front end of a tool for squeezing out separate components of a mass.

In FIG. 1 a member is mounted on the front end 3 of a known tool for squeezing-out components and is made up of an axially extending mixing tube 1 and an axially extending tube section 2 coaxial with and positioned within the mixing tube. The front end 3 of the tool is outlined in dash-dot lines. A first outlet 3*a*, shown in the closed position, the open position being shown by solid lines, is located in the front end 3 and a second outlet 3*b* is coaxial with and spaced downstream in the squeezing-out direction from the first outlet 3*a*. As illustrated, the first outlet 3*a* discharges one component into the mixing tube 1 and the second outlet 3*b* discharges another component into the tube section 2.

Furthermore, FIG. 1 shows the tube section 2 supported and stabilized in the mixing tube 1 by ribs 4 extending radially between the tube section and the mixing tube. In addition, tube section 2 has an axially extending bore 2*a* tapering slightly in the dispensing direction, that is to the left in FIG. 1, and at its downstream end opens into radial outlets 2*b*. Radial outlets 2*b* located in the downstream region of tube section 2 are enclosed by an elastic sheath 5. Elastic sheath or jacket 5 is connected to the tube section 2 at its downstream end, that is the end closer to the discharge end, not shown, of the mixing tube 1. The downstream end section of the tube section 2 has rearwardly extending protrusions 2*c* holding the end of the sheath 5. Sheath 5 can be squeezed into and, if necessary, additional bonded in the spaces formed by the protrusions 2*c*. At its opposite or upstream end, the sheath 5 is radially expandable by the pressure of the component flowing through the tube section 2 from the second outlet 3*b*, so that in this region the component flowing out of the openings 2*b* can pass into the mixing tube 1 after expanding the sheath and mix with the other component flowing from the first outlet 3*a*. At its upstream end, the mixing tube 1 adjoining the tool 3 can be provided with one or more recesses distributed around its upstream end face, for instance in the form of notches 1*a* so that edges are formed at the upstream end face of the mixing tube 1. These edges can be used for cleaning the adjacent region of the tool by turning the mixing tube 1 around its axis for removing any residues of the individual components.

Figure 2:
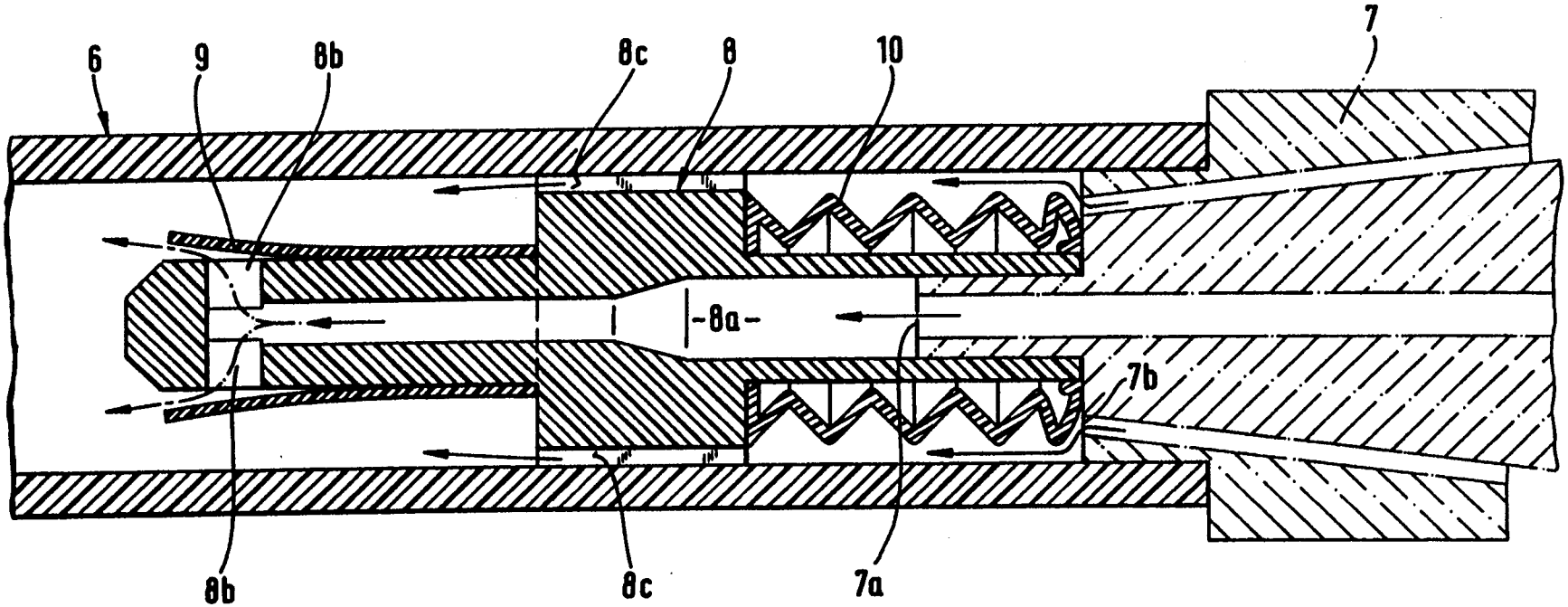
FIG. 2 is a cross-sectional view, similar to FIG. 1, however, illustrating a member with two one-way valves and showing diagrammatically the front end of a tool for squeezing-out the components.

In FIG. 2 another embodiment of the member is shown mounted on the front end 7 of the tool for squeezing out the components. The front end 7 of the tool is shown in dash-dot lines. An axially extending mixing tube 6 of the member is fitted on the front end 7 of the tool. Front end 7 has a first outlet 7*a* and a second outlet 7*b* shown in the open position with the first outlet 7*a* located coaxially with the mixing tube 6 and spaced radially inwardly from the second outlet 7*b*. As shown in FIG. 2, the first outlet 7*a* discharges into the upstream end region of a tube section 8 spaced inwardly from and extending coaxially within the mixing tube 6. Tube section 8 has an axially extending bore 8*a* tapering slightly inwardly in the squeezing-out direction of the tool, that is to the left in FIG. 2, and at its downstream end the bore opens into radially extending outlets or openings 8*b*. The openings 8*b* located in the outlet region of the tube section 8 are enclosed by an elastic sheath 9. The elastic sheath is radially deformable by the pressure of the component flowing trough the bore 8*a* in the region of the openings 8*b*. The tube section 8 is secured and stabilized by ribs 8c which abut against the inside surface of the mixing tube 6. The component from the tube section 8 flows out of the downstream end of the elastic sheath 9.

A bellows 10 laterally encloses the tube section 8 adjacent its upstream end. Bellows 10 covers or closes the second outlet 7b. The pressure of the component squeezed out of the front end 7 of the tool through the second outlet 7b axially displaces the upstream end of the bellows so that the component can flow into the annular space between the bellows, the tube section 8 and the outer mixing tube 6. The individual components flowing out of the outlets 7a, 7b intermix in the region of the passages 8b within the mixing tube 6. As can be seen in FIG. 2 the component flows out of the tube section 8 between the expanded sheath 9 and the downstream end of the tube section 8.

Plastics material is suitable for the mixing tube 1, 6 as well as for the tube section 2, 8. The sheath 5, 9 and the bellows 10 are preferably formed of plastics material, however, such plastics material must be very elastic.

While a specific embodiment of the invention has been shown and described in detail to illustrate the inventive principles, it will be understood that the invention may be embodied otherwise without departing from said principles.

We claim:

1. A member for mixing and dispensing a two-component mass in combination with a tool, which separately squeezes out first and second components of the two-component mass and comprises a dispensing part for discharging the first and second components squeezed-out from the tool, the dispensing part having a first outlet for discharging the first component and a second outlet for discharging the second component, said member comprising:

an axially extending mixing tube;

an axially extending tube section coaxially supported in the mixing tube and having an upstream end located adjacent to the first outlet for receiving the first component dischargeable through the first outlet, a downstream end remote from the first outlet, and at least one radial opening formed in the downstream end of the tube section for discharging the first component, which flows from the first outlet through the tube section, into the mixing tube;

an elastically deformable sheath surrounding the downstream end of the tube section and having one end thereof, remote from the at least one radial opening, connected to the tube section, another end of the sheath, surrounding the at least one radial opening, defining a first one-way valve enabling flow of the first component out of the radial opening but preventing flow of the second component into the at least one radial opening; and a second one-way valve for controlling flow of the second component through the second outlet, the second one-way valve comprising a bellow extending axially in the mixing tube and having an end surface thereof closing the second outlet, the end surface being displaceable from a closed position thereof under pressure of the second component flowing through the second outlet.

2. The member as set forth in claim 1, wherein the tube section is connected to the dispensing part at the upstream end thereof, and wherein an annular space between the tube section and the mixing tube defines a passage for the second component.

3. A member for mixing and dispensing a two-component mass in combination with a tool, which separately squeezes out first and second components of the two-component mass and comprises a dispensing part for discharging the first and second components squeezed-out from the tool, the dispensing part having a first outlet for discharging the first component and a second outlet for discharging the second component, said member comprising:

an axially extending mixing tube;

an axially extending tube section coaxially supported in the mixing tube and having an upstream end located adjacent to the first outlet for receiving the first component dischargeable through the first outlet, a downstream end remote from the first outlet, and at least one radial opening formed in the downstream end of the tube section for discharging the first component, which flows from the first outlet through the tube section, into the mixing tube, the downstream end having a proximate end portion in which the at least radial opening is formed, and a distal end portion remote from the at least one radial opening; and an elastically deformable sheath surrounding the downstream end of the tube section and having proximate and distal ends, the distal end being fixedly secured to the distal end portion of the tube section, and the proximate end surrounding the proximate end portion and defining a one-way valve enabling flow of the first component out of the at least one radial opening and preventing flow of the second component into the at least one radial opening.

* * * * *